US006260662B1

(12) United States Patent
Meister et al.

(10) Patent No.: US 6,260,662 B1
(45) Date of Patent: Jul. 17, 2001

(54) RECTRACTABLE EXTENSION FOR THE GUIDING RAIL OF A CLIMBING GUARD

(75) Inventors: Klaus Meister, Helmbrechts; Thomas Keller, Weissdorf, both of (DE)

(73) Assignee: Soll GmbH, Hof (DE)

( * ) Notice: Subject to any disclaimer, the term of this patent is extended or adjusted under 35 U.S.C. 154(b) by 0 days.

(21) Appl. No.: 09/462,185

(22) PCT Filed: Jul. 17, 1998

(86) PCT No.: PCT/EP98/04460

§ 371 Date: Jan. 4, 2000

§ 102(e) Date: Jan. 4, 2000

(87) PCT Pub. No.: WO99/04127

PCT Pub. Date: Jan. 28, 1999

(30) Foreign Application Priority Data

Jul. 18, 1997 (DE) ..... 297 12 753

(51) Int. Cl.[7] ..... E06C 7/18
(52) U.S. Cl. ..... 182/106; 182/8
(58) Field of Search ..... 182/106, 8, 100, 182/189, 207

(56) References Cited

U.S. PATENT DOCUMENTS

| | | | | |
|---|---|---|---|---|
| 3,523,591 | * | 8/1970 | Fountain | 182/8 |
| 3,598,200 | | 8/1971 | Thompson . | |
| 4,546,855 | | 10/1985 | Lyons . | |
| 4,709,783 | * | 12/1987 | Tomioka | 182/8 |
| 5,282,339 | | 2/1994 | Devlin et al. . | |
| 5,931,258 | * | 8/1999 | Lorentz | 182/106 |

FOREIGN PATENT DOCUMENTS

| | | |
|---|---|---|
| 1 961 757 | 6/1971 | (DE) . |
| 27 36 037 | 2/1979 | (DE) . |
| 33 22 298 | 7/1984 | (DE) . |
| 88 09 386 | 12/1988 | (DE) . |
| 0 168 021 | 7/1985 | (EP) . |
| 2 691 488 | 5/1992 | (FR) . |

OTHER PUBLICATIONS

"Fallschutzsysteme Sicherheitsgeschirre Steigeisen; Announcement," *HACA*, pp. 1–44 (Mar. 1990).

* cited by examiner

*Primary Examiner*—Alvin Chin-Shue
(74) *Attorney, Agent, or Firm*—Hoffmann & Baron, LLP

(57) ABSTRACT

The device for allowing a person to safely step off from and onto a climbing track on a roof edge, a roof slope, a shaft opening or similar, includes a guide rail (10) for guiding a catching device to which a person using the climbing path can be secured, and an extension piece (24) of the guide rail (10). The extension piece (24) of the guide rail (10) can be moved between a first and a second position, the extension piece (24) being so arranged in the first position that it does not project above the guide rail (10), and being aligned in longitudinal direction with the guide rail in the second position. The extension piece (24) can be guided displaceable along the guide rail (10) and at a distance from the latter and can be swivelled by 180° in the final position, which corresponds to the second position, so that it is in alignment with the extension (10).

4 Claims, 4 Drawing Sheets

RECTRACTABLE EXTENSION FOR THE GUIDING RAIL OF A CLIMBING GUARD

BACKGROUND OF THE INVENTION

1. Field of the Invention

The invention relates to a device for allowing a person to safely step off from and onto a climbing track when crossing onto a platform, the roof of a structure, a landing or when leaving or entering a shaft. The device has a guide rail for guiding a catching device, onto which a person negotiating the climbing track can be secured, and an extension piece of the guide rail at the top end of the guide rail.

2. Description of the Prior Art

The accident prevention regulations stipulate that for ladder ends against roof edges, roof slopes or shafts the ladder must project by 1 m. A ladder with such a projection is known from DE-U-88 09 386. The projection or the extension is arranged swivellable about a vertical axis at the top end of the ladder. This device is not suitable for dormer windows or shaft coverings, as the shaft covering or the skylight would collide with the projection. For shaft coverings and skylights, the projection was housed separately up until now and attached to the top of the ladder when being used.

OBJECTS AND SUMMARY OF THE INVENTION

The object of the invention is to create a device for safely stepping off from a climbing track which is easy to operate and does not require a ladder extension to be attached.

According to the invention this object is achieved in that the extension of the guide rail can be moved between a first position and a second position, the extension piece being so arranged in the first position that it does not project significantly above the guide rail, and in the second position providing an aligned upward extension of the guide rail in alignment with the latter.

Because the extension piece of the guide rail can be moved between two positions, it is no longer necessary to store or to carry the extension piece separately.

The extension piece of the guide rail can be linked to the top end of the guide rail by means of a hinge. The arrangement is particularly space-saving if the extension piece is housed behind the guide rail in a vertically moveable manner. In order to create a connection to the top end of the guide rail, the extension piece is preferably developed as a hinge swivellable about a vertical axis. When used, the extension piece is firstly pulled or pushed up as far as a stop and then rotated by 180° about the vertical axis and then fitted onto the end of the securely mounted guide rail. By means of centering brackets on the top end of the securely attached guide rail, a mis alignment between the extension piece and the guide rail is prevented and a safe crossing of the connection point with a catching device is guaranteed.

In order to bring the extension piece into the first or at-rest position, the extension piece is lifted, swivelled by 180° and then lowered or retracted. In the first position, the extension piece is stowed behind the guide rail in an extremely space-saving way, i.e. in general between the guide rail and the masonry, to which the guide rail is attached.

The extension piece is preferably attached to a pipe which is arranged vertically displaceable by two pairs of guide rolls and is rotatable about its longitudinal axis.

The two pairs of guide rolls are preferably housed at the top end of the securely attached guide rails.

The device according to the invention is particularly suitable for use with single-spar or central-spar ladders with fall-prevention means, as means known from DE-A-19 61 757. The pipe to which the extension piece is attached can be housed parallel and at a small distance behind the central-spar by means of the guide rolls with such a central-spar ladder.

An embodiment of the invention is explained in the following with the help of the diagram.

Figure 1:
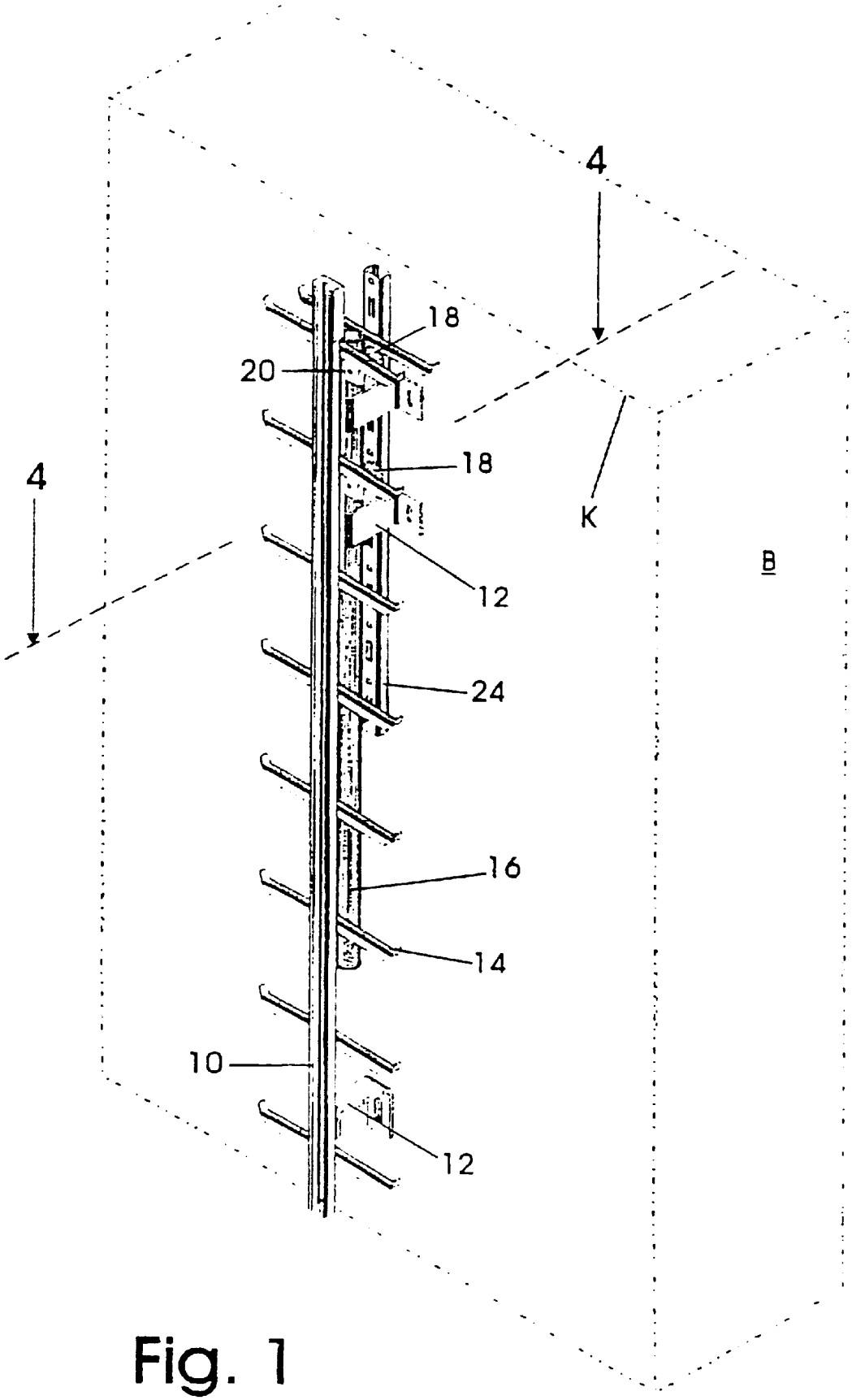
FIG. 1 the guide rail with the retracted extension piece.
Figure 2:
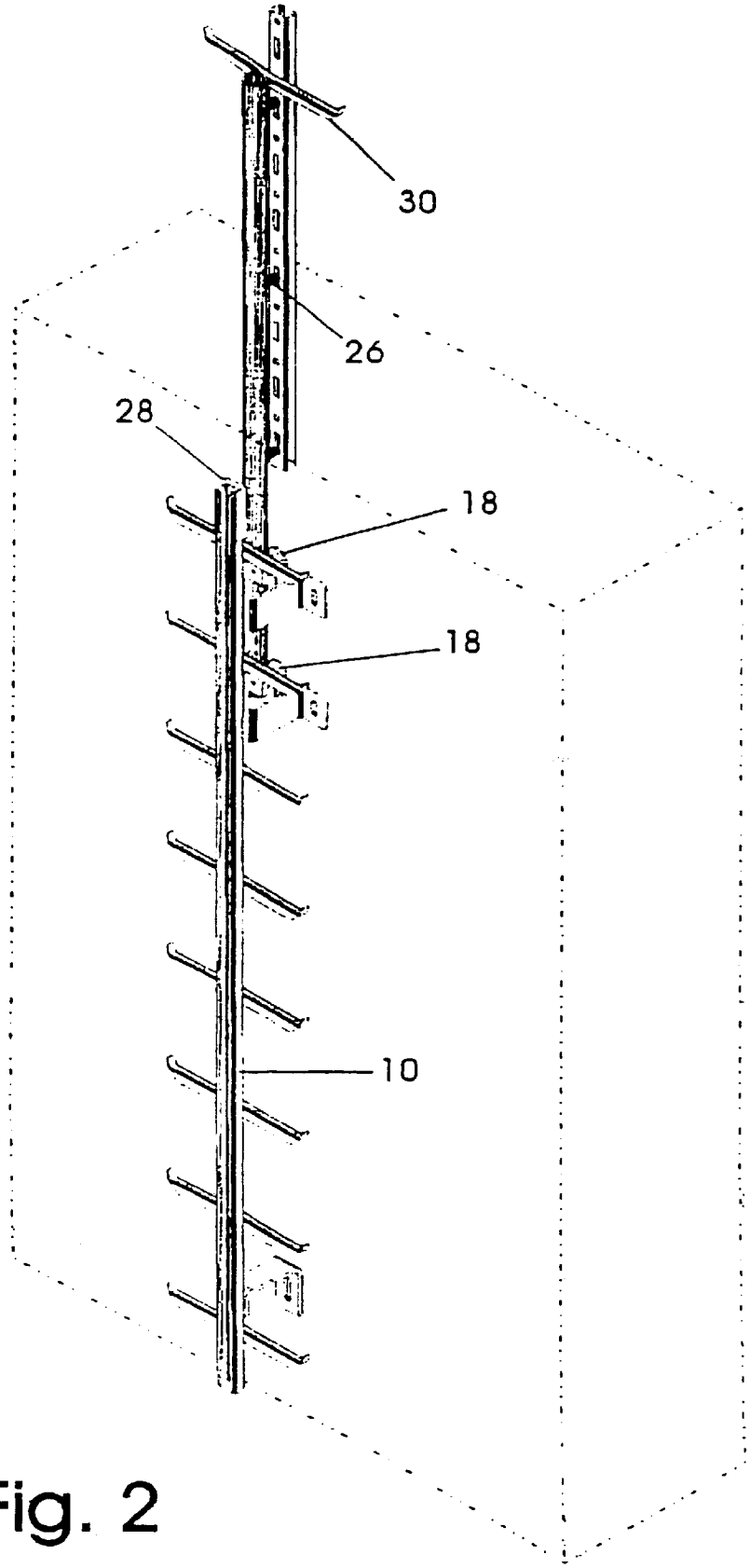
FIG. 2 the guide rail with the deployed extension piece.
Figure 3:
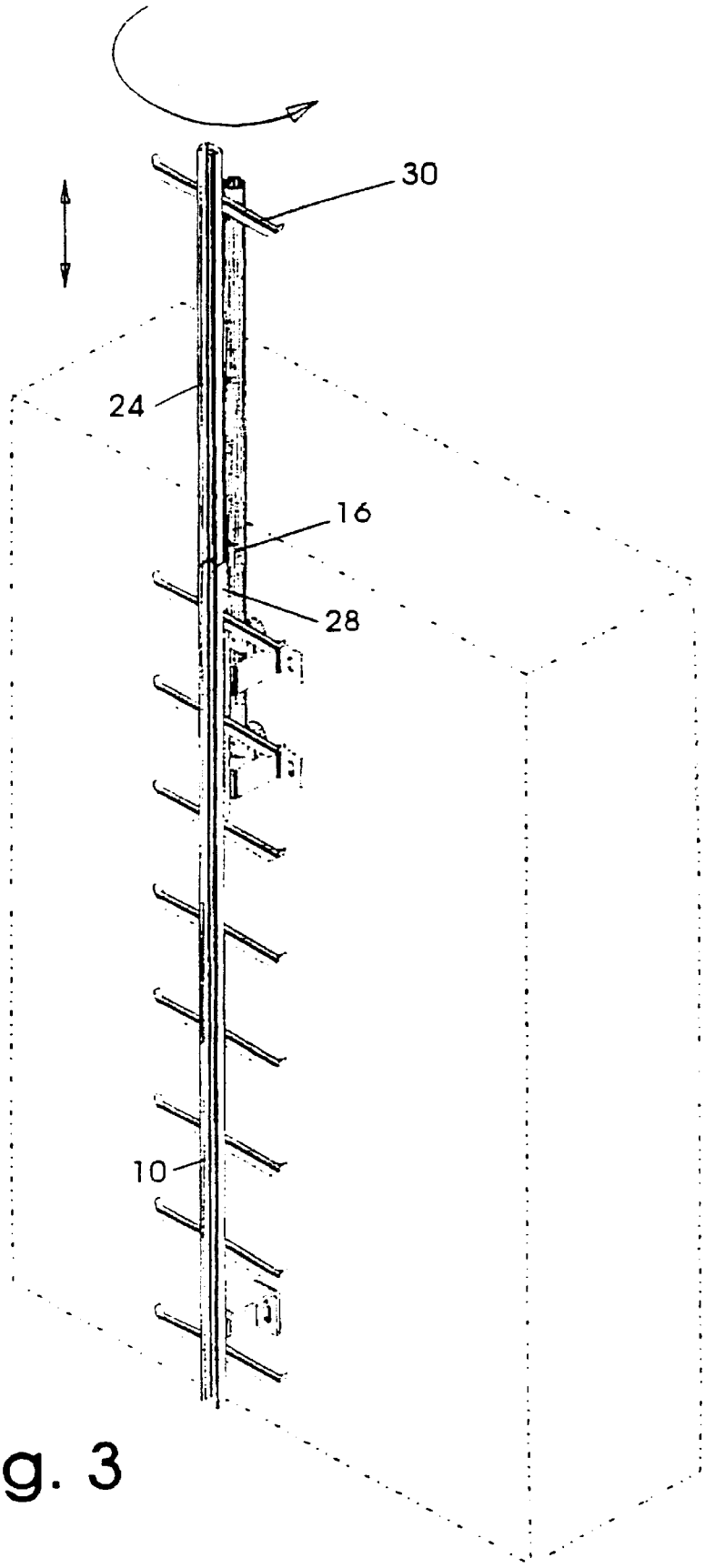
FIG. 3 the guide rail with the extension piece deployed and inserted into the top end of the guide rail after a swivel movement of 180°.
Figure 4:
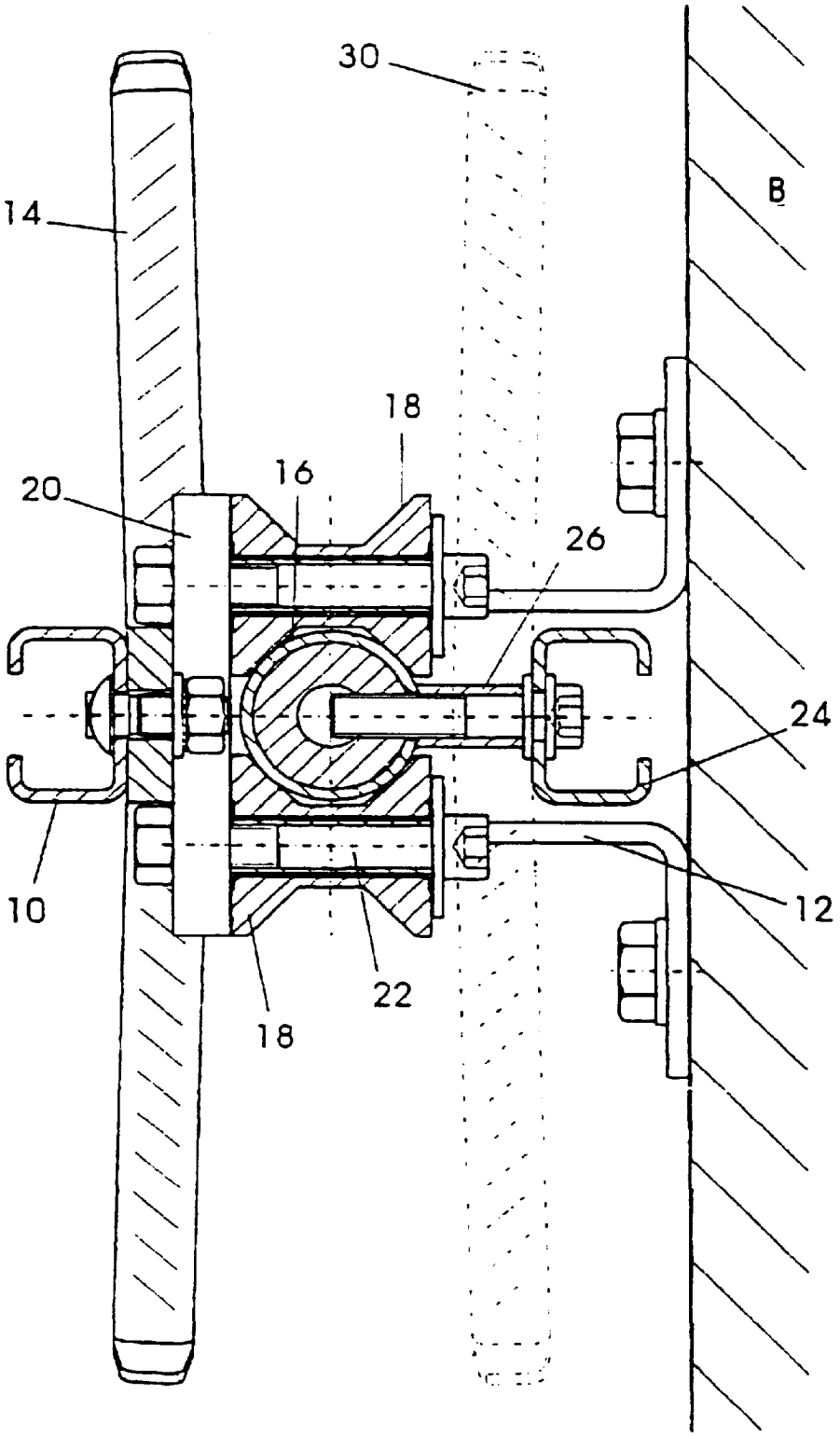
FIG. 4 a section 4—4 of FIG. 1.

In the embodiment shown in the diagram, a guide rail 10 is firmly secured by means of brackets 12 to a structure B, for example the inside wall of a shaft. Treads 14 are attached to the rear of the guide rail 10 at regular intervals. The guide rail 10 forms together with the treads 14 a single-spar or central-spar ladder.

At the same time the guide rail 10 serves to guide a catching device not shown in the diagram, which together with the guide rail 10 is a part of fall-prevention means as known from DE-A-19 61 757, DE-A-27 36 037 and EP-AP-0 168 021.

In the space between the guide rail 10 and the structure B a pipe 16 is housed directly behind the guide rail 10 by two pairs of guide rolls 18, so that the pipe 16 is displaceable parallel to the guide rail 10, i.e. can be pulled upwards and retracted downwards. Each pair of guide rolls 18 is mounted on a carrier plate 20, which is attached to the rear side of the guide rail 10. The guide rolls 18 sit on journals 22, which are vertical to the guide rail 10 and the treads 14. The distance between the guide rolls 18 of each pair is chosen so that the pipe 16 is held between them with as little play as possible. The surface of the guide rolls 18 is matched to the circular periphery of the pipe 16. In the area of movement of the pipe 16, the brackets 12 are attached laterally in order to create space for the pipe 16.

An extension piece 24 is attached along the pipe 16 by means of spacers. The extension piece 24 is a section of the same profile rails as the guide rail 10. The length of the spacers 26 is so chosen that the extension piece 24 is the same distance from the pipe 16 in which the pipe 16 is housed behind the guide rail. If the pipe 16 is therefore rotated by 180° its longitudinal axis, then the extension piece 24 aligns with the guide rail 10. Attached to the top end of the guide rail 10 are centering brackets 28 into which the extension piece 24 can be inserted, so that a twisting of the extension piece 24 vis-a-vis the guide rail 10 is prevented and a catching device can safely cross the connection point between the guide rail 10 and the extension piece 24.

The extension piece 24 does not extend along the entire length of the pipe 16. At the bottom end of the pipe 16 a length is free which is somewhat greater than the distance between the two pairs of guide rolls 18, so that the pipe 16 is always held by both pairs of guide rolls 18 when the extension piece 24 is connected to the top end of the guide rail 10. The extension piece 24 can project somewhat over the top end of the pipe 16 and a grip 30 is also provided at this point, which, for simplicity's sake, can be shaped like a tread 14. Otherwise no further treads or grips are provided on the extension piece 24, as they would interfere during the retraction of the pipe 16. In the retracted position of the pipe 16, the grip 30 sits on the topmost guide rolls 18. Situated at the bottom end of the pipe 16 is a stop, not shown, which prevents the pipe 16 from being completely pulled out.

The extension piece 24 can adopt two stable positions. In the first position it is retracted, the top end of the connection piece 24 and also of the pipe 16 not, or only minimally, projecting over the top end of the guide rail 10. The extension piece 24 can be pulled upwards from this first position by the grip 30. In the process, the pipe 16 is guided through the guide rolls 18. The spacers 26 are so dimensioned that, on the free side of the guide rolls 18, they can pass through these. If the extension piece 24 is completely pulled out, then it is swivelled by 180° with the pipe 16 about the longitudinal axis of the pipe 16 and is then fitted onto the top end of the guide rail 10 by means of the centering brackets 28. Between the guide rolls 18 and the pipe 16 there is sufficient play to be able to rotate the pipe 16 between the guide rolls 18. In the second, extended position, the extension piece 24 projects by at least 1 m over the edge K of the structure B. Depending on the application of the climbing guard system, anti-escape means are also provided at the top end of the guide rail 10 and of the extension piece 24, which prevents the catching device guided on the guide rail 10 and the extension piece 24 from inadvertently being pulled out from the top ends.

If the described fall-prevention system is for example used for a sewer shaft, then the extension piece 24 is pulled out after the opening of the shaft, swivelled by 180° and fitted onto the guide rail 10. The catching device is then fitted into the extension piece 24 at the top and the user can descend safely into the shaft.

What is claimed is:

1. Device for allowing a person to step safely off and onto a climbing track on a roof edge, a roof slope, a shaft opening and the like, the device comprising:

a guide rail for guiding a catching device to which a person using the climbing track can be secured; and an extension piece of the guide rail, means connecting said extension piece to said guide rail with their respective longitudinal axis in transversely spaced relationship, the extension piece being movable along the guide rail between a first position and a second position and does not project above the guide rail in the first position and, in the second position, the extension piece pivots 180 degrees about a vertical axis of the connecting means from the first position to the second position wherein its longitudinal axis is aligned with the longitudinal axis of the guide rail.

2. Device according to claim 1, wherein the connecting means comprises a pipe, which runs on the rear of the guide rail between guide rolls and is rotatable about its longitudinal axis.

3. Device according to claim 2, wherein the extension piece is attached to the pipe by spacers and the guide rolls sit on journals which stick out to the rear from guide rails, the guide rolls not encompassing the complete periphery of the pipe so that the spacers can pass between the guide rolls.

4. Device according to claim 1, wherein a grip is provided at the top end of the extension piece.

* * * * *